US008006851B2

(12) United States Patent
Morini

(10) Patent No.: US 8,006,851 B2
(45) Date of Patent: Aug. 30, 2011

(54) CHILD-PROOF CAPSULE WITH A SYRINGE DOSER

(75) Inventor: Emilio Morini, Colorno (IT)

(73) Assignee: Bormioli Rocco & Figlio S.p.A., Fidenza (IT)

( * ) Notice: Subject to any disclaimer, the term of this patent is extended or adjusted under 35 U.S.C. 154(b) by 634 days.

(21) Appl. No.: 11/814,778

(22) PCT Filed: Nov. 29, 2005

(86) PCT No.: PCT/IT2005/000699

§ 371 (c)(1),
(2), (4) Date: Jul. 25, 2007

(87) PCT Pub. No.: WO2007/063558

PCT Pub. Date: Jun. 7, 2007

(65) Prior Publication Data

US 2009/0272713 A1 Nov. 5, 2009

(51) Int. Cl.
*B65D 55/02* (2006.01)

(52) U.S. Cl. ..... 215/220; 215/277

(58) Field of Classification Search ..... 215/247, 215/249, 277, 220

See application file for complete search history.

(56) References Cited

U.S. PATENT DOCUMENTS

| | | | |
|---|---|---|---|
| 3,980,211 | A | 9/1976 | Owens |
| 4,396,134 | A | 8/1983 | Owens |
| 4,494,682 | A | 1/1985 | Beckstrom et al. |
| 2005/0161425 | A1 | 7/2005 | Morini |

FOREIGN PATENT DOCUMENTS

| | | | |
|---|---|---|---|
| EP | 1 501 740 | A1 | 2/2005 |
| FR | 2 309 424 | A1 | 11/1976 |
| FR | 2 862 620 | A1 | 5/2005 |
| WO | WO 03093129 | A1 | 11/2003 |

*Primary Examiner* — Anthony Stashick
*Assistant Examiner* — James N Smalley
(74) *Attorney, Agent, or Firm* — Pearne & Gordon LLP

(57) ABSTRACT

The capsule comprises: an internal capsule (4), which inserts removably in a mouth (2) of a container (1) to be closed, having an external cover (5), creating a security opening of the container (1); a reducer (7) which is applied on the mouth (2) of the container (1) and which is provided with an upper wall (70), in which a hole (71) is afforded, in which a syringe doser (8) can be introduced. The reducer (7) comprises: at least a radial projection (72) in the upper wall (70) thereof, which inserts in an annular recess (40) internally afforded in the upper part of the internal capsule (4); a first annular cavity (73), delimited by an external wall (74) and an internal wall (75) which develop axially below the upper wall (70) of the reducer (7), in which upper wall (70) an overhang (20) developing axially from the upper end of the mouth (2) of the container (1) is anchored.

6 Claims, 3 Drawing Sheets

CHILD-PROOF CAPSULE WITH A SYRINGE DOSER

TECHNICAL FIELD

The invention relates to a child-proof capsule with a syringe doser. The capsule is usefully applied on all containers the opening of which is made difficult for children and the contents of which are destined to be used, in particular in pre-determined doses, for children.

BACKGROUND ART

The prior art comprises child-proof capsules in which the opening can be performed only with a succession of coordinated movements that are difficult for children below a certain age to do. For containers destined in particular to contain paediatric medicines, in which the capsule is placed on a container containing the product, the prior art includes application thereon of syringe dosers, also of known type, which enable a predetermined dose of product to be dispensed from the container.

Child-proof capsules comprise an internal capsule, provided with means for connection, normally of the screw type, which enable removable insertion thereof on the mouth of the container to be closed, and an external lid (capsule cover) which covers the internal capsule on which it is arranged. The external lid is constrained to the internal capsule in such a way that two states thereof can be achieved: one in which the lid is free to rotate (the child-proof or safety position) and one in which the lid is solid in rotation with the internal capsule according to distinct relative axial positions of one with respect to the other. In these types of capsules it is extremely important that there are not parts of the capsule, especially small parts, which can detach from the capsule itself.

One of these capsules is, for example, illustrated in European patent application no. EP 1.501.740, belonging to the present applicant.

When a syringe doser is to be applied on a capsule of this type, which is considerable well known in the art and is supplied to the user with the container but separately of the capsule, in known capsules a section reducer is used which consists in a perforated cap, the hole having a diameter which is equal to the external diameter of the syringe, which cap is applied on the mouth of the container; when the capsule is removed from the container the syringe is moved into the hole in the perforated cap in order to enable, by pressing the piston thereof, removal of the desired dose of product from the container; the doser is then removed from the container and the substance is generally injected directly into the child's mouth.

In known-type. capsules it quite frequently occurs that when removing the syringe with the product from the container, the reducer is also extracted from the mouth of the container and falls or remains connected to the syringe; this fact, irritating in itself, can also be a risk because the reducer, which is quite small, can inadvertently be ingested by the child who finds it or who detaches it from the syringe while the product is being dispensed. These things have actually happened and obviously represent a risk which is intolerable in particular if caused by an object (the child-proof capsule) made with the aim of providing maximum safety conditions for the user and in particular for children.

The main aim of the present invention is to provide a child-proof capsule which is provided with a reducer for insertion of a syringe in which it is impossible or at least very difficult to detach parts which, during the administration of the products, can be inadvertently ingested.

A further aim of the present invention is to provide a capsule which is easily insertable, with automatic packaging machines, on a container in order to obtain the packaging for which the capsule is destined.

An advantage of the present invention is that it provides a capsule of a type in which the reducer hole does not deform during packaging.

DISCLOSURE OF INVENTION

The above aims and others besides are all attained with the invention, as it is characterised in the claims that follow.

Further characteristics and advantages of the present invention will better emerge from the detailed description that follows of a preferred but non-exclusive embodiment of the invention, illustrated purely by way of non-limiting example in the accompanying figures of the drawings, in which.

Figure 2:
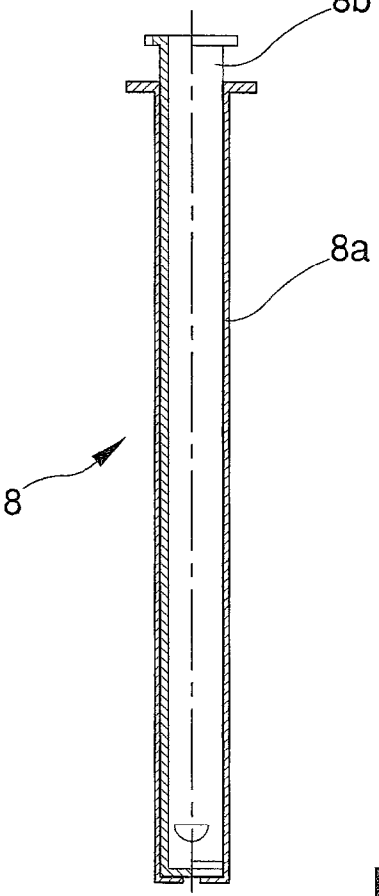
FIG. 2 is a partially-sectioned vertical elevation of the syringe to be applied on the capsule of the invention.
Figure 1:
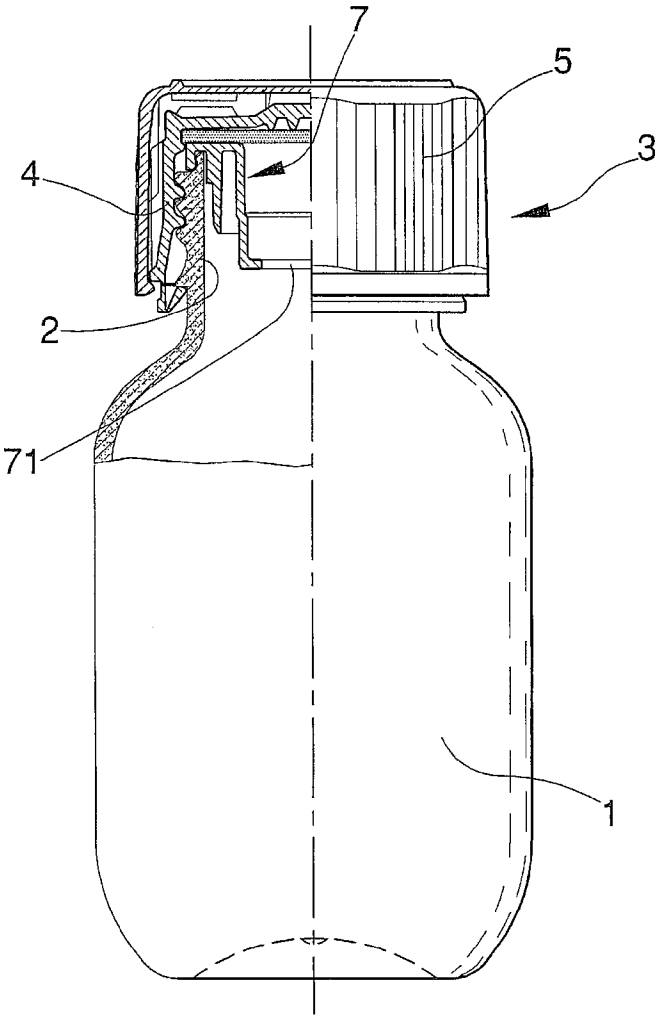
FIG. 1 is a partially-sectioned vertical elevation of the capsule of the invention mounted on a container.
Figure 3:
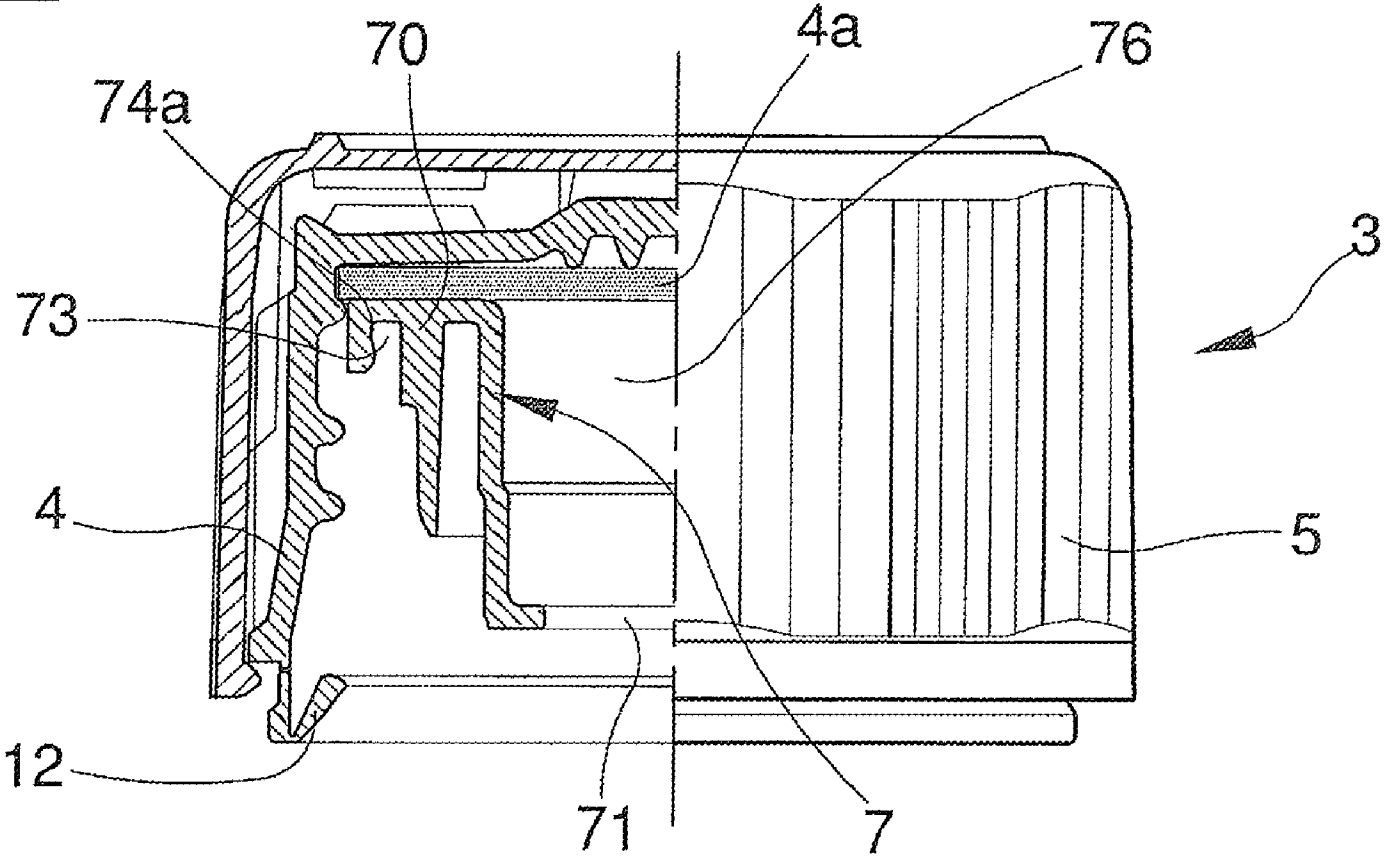
FIG. 3 is a partially-sectioned vertical elevation in enlarged scale of the capsule of the invention.
Figure 4:
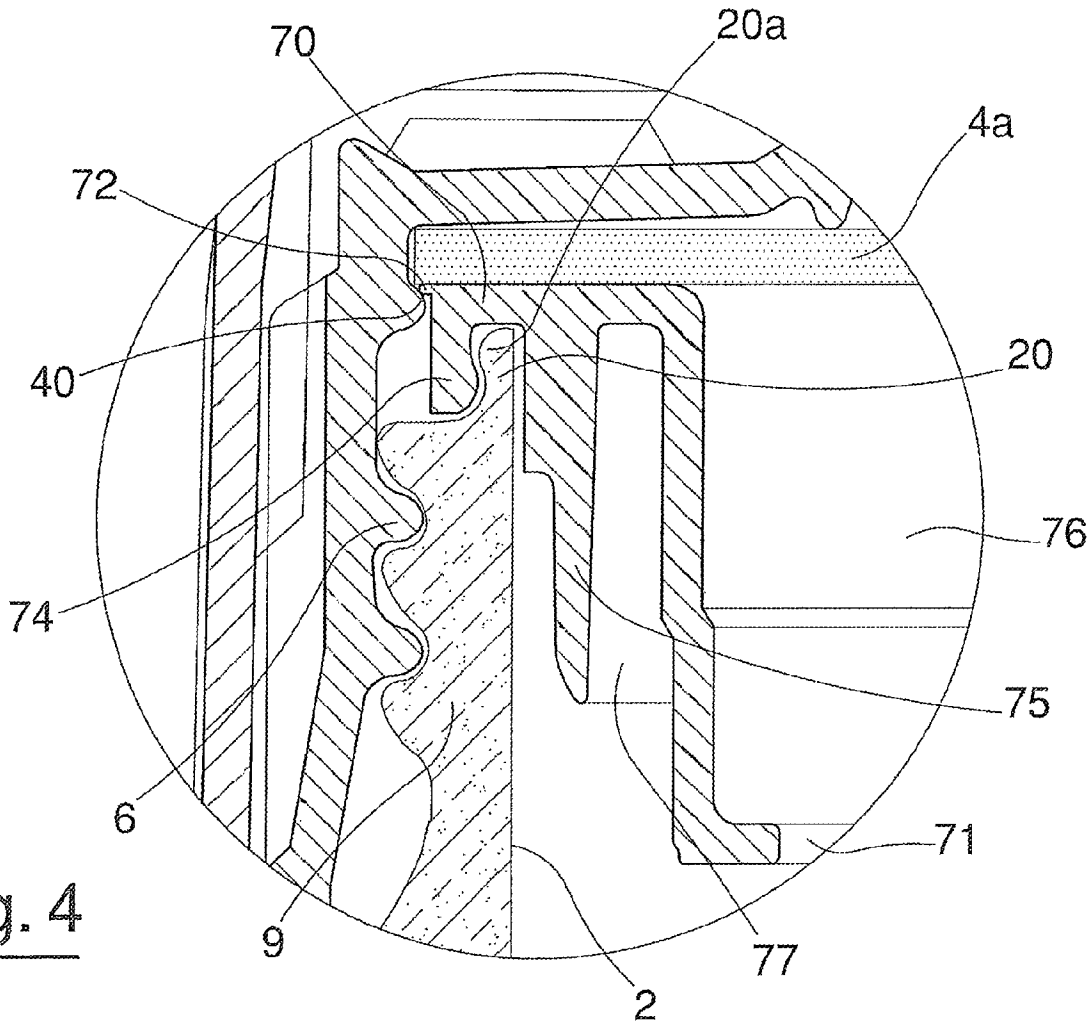
FIG. 4 is an enlarged-scale detail of FIG. 3.

In the figures of the drawings, 1 denotes a container, the mouth of which 2, located at the end of the neck of the container, is closed by a capsule 3 of the child-proof type of the invention. The capsule comprises an internal capsule 4 provided with an internal threading 6 by means of which the internal capsule can be screwed on a corresponding thread 9 afforded on the mouth 2. A security strip 12, made in a single piece with the internal capsule 4, is located on the lower peripheral edge of the internal capsule 4. The security strip 12 is generally conformed, in a known way, in such a way as to break on the first opening of the container, while no parts thereof come away from the container itself. In the internal upper part of the capsule 4 there is normally a seal gasket 4*a*. An external cover 5 is located on the internal capsule 4. The conformation of the internal capsule 4 and the cover 5, as well as their coupling which produces a security opening, are entirely similar to those of known capsules such as, for example, the capsule described in EP patent application EP 1.501.740.

The capsule of the invention further comprises a reducer 7, which is applied on the mouth 2 of the container 1 and which is provided with an upper wall 70 which, when the reducer is applied on the container, rests on the upper part of the mouth (2); a hole 71 is afforded in the reducer, which hole 71 is accessible from the outside when the internal capsule is removed from the container, in which hole 71 a syringe doser 8 can be lodged.

The reducer 7 comprises a radial projection 72, which projects from the upper wall 70 of the reducer 7. A plurality of radial projections 72 could be included, distinct one from another, which develop along an ideal circumference of the upper wall 70 of the reducer, i.e. they all project from the wall 70 by a same length.

The projection (or projections) 72 is conformed in such a way as to insert, in the ways described herein below, in an annular recess 40 afforded internally of the upper part of the internal capsule 4.

The reducer 7 further comprises a first annular cavity 73 which is delimited by two walls, respectively an external wall 74 and an internal wall 75, which develop axially below the upper wall 70 of the reducer 7. The first annular cavity 73 internally exhibits an annular recess 74*a* which is preferably afforded in the upper internal part of the external wall 74; in other words, the recess 74*a* represents an undercut with respect to the front part of the cavity 73.

An overhang 20 is exhibited on the mouth 2 of the container, which develops axially from the upper end of the mouth 2 towards the outside, which is provided with an annular projection 20*a*.

The conformations of the cavity 73 and the overhang 20 are such that, when the capsule is inserted on the container, the overhang 20 inserts in the cavity 73; the presence of the annular projection 20*a*, which inserts in the annular recess 74*a*, makes the connection between the container and the reducer especially stable.

When the capsule is inserted on the container, the internal wall 75 inserts sealingly internally of the mouth 2; the internal wall 75 is conformed in such a way that the length of the part thereof coming into contact with the inside of the mouth 2 is equal at least to a sixth of the internal diameter of the mouth 2. This, apart from guaranteeing a good seal between the reducer and the container, increases the stability of the contact between the reducer and the container and also reduces the possibility that reducer can be unseated from the container.

The reducer further comprises a cylindrical cavity 76, which is superiorly open and is coaxial to the reducer 7. The hole 71 is afforded at the bottom of the cylindrical cavity 76 for introduction of the syringe doser. There is also a second annular cavity 77, coaxial to the first annular cavity 73 and internal thereof, which is delimited by the wall 75 and by the wall of the cylindrical cavity 76.

The second annular cavity enables an increase in the friction interference between the reducer 7 and the mouth 2 of the container, making the anchoring between the two elements stronger and more secure, without creating deformations in the zone in which the syringe doser is to be introduced. It also prevents any stress caused by the doser on the reducer to unload on the parts in contact between the reducer 7 and the mouth 2, thus contributing to diminishing the possibility of the reducer 7 being unseated from the container.

The realisation of the external cover 5 and the internal capsule 4 are done in known ways, with the sole difference that in the internal capsule 4 there is the annular recess 40 described above; the reducer, conformed as described above, is realised in a usual way, by injection moulding.

Once the separate pieces have been made, the manufacturer inserts, in a known way, the cover onto the internal capsule; then the reducer is inserted internally of the capsule 4 in such a way that the annular projection 72 inserts in the annular recess 40. The connection between the internal capsule and the reducer is simple, inasmuch as it has only a simple function, that of keeping all the elements making up the capsule assemble in a single assembly up until insertion thereof on the container; this considerably eases packaging. operations for the companies preparing the packages using this capsule.

The user, wishing to remove the contents of the container, unscrews the internal capsule 4 from the mouth of the container, following the usual procedures for child-proof capsules, which include first a pressure on the cover 5 and the internal capsule 4 of the mouth of the container; this operation causes the exit of the annular projection 72 from the annular recess 40 and the opening of the container; the reducer 7 remains solidly anchored to the mouth 2 of the container inasmuch as the connection between the reducer and the mouth is much more stable with respect to the connection between the reducer and the internal capsule.

During the insertion operations of the doser 8 in the hole 71, the aspiration of the contents of the container and the extraction of the doser from the hole, for the above-described reasons there will be no accidental detachment of the reducer from the container. It is also extremely difficult, especially for a child not equipped with mechanical tools but working only with his hands or mouth, to unseat the reducer from the container.

The capsule of the invention both achieves the aim of preventing the accidental detachment of the reducer from the container and offers the advantages of having an easily-insertable capsule, with automatic packaging machines, on the container, which is also difficult to deform during packaging and use.

The invention claimed is:

1. A child-proof capsule (3) with a syringe doser, comprising: an internal capsule (4), provided with means for connecting which enable removable insertion thereof in a mouth (2) of a container (1) to be closed; an external cover (5), arranged on the internal capsule (4) and constrained to the capsule (3) in order to create a known-type security opening of the container (1); a reducer (7) which is applied on the mouth (2) of the container (1) and which is provided with an upper wall (70) which rests on an upper part of the mouth (2), in which a hole (71) is afforded, accessible from outside when the internal capsule (4) is removed from the container (1), in which a syringe doser (8) can be introduced; wherein the reducer (7) comprises: at least a radial projection (72), which projects from the upper wall (70) of the reducer (7), which inserts in an annular recess (40) internally afforded in the upper part of the internal capsule (4); a first annular cavity (73), delimited by an external wall (74) and an internal wall (75) which develop axially below the upper wall (70) of the reducer (7), in which an overhang (20) developing axially from the upper end of the mouth (2) of the container (1) is anchored when the capsule is inserted on the container (1); applying a pressure on the cover (5) and the internal capsule (4) and unscrewing the internal capsule (4) from the mouth of the container causing the exit of the projection (72) from the annular recess (40) and the opening of the container; the reducer (7) remaining solidly anchored to the mouth (2) of the container inasmuch as the connection between the reducer (7) and the mouth (2) is much more stable with respect to the connection between the reducer (7) and the internal capsule (4).

2. The capsule of claim 1, wherein the reducer (7) comprise a plurality of radial projections (72) distinct one from another, which are along an entire circumference of the upper wall (70) of the reducer (7).

3. The capsule of claim 1, wherein the first annular cavity (73) provides an annular recess (74*a*), afforded in the upper internal part of the external wall (74), in which an annular projection (20*a*) fashioned on the overhang (20) is inserted at the moment when the capsule is applied on the container.

4. The capsule of claim 1, wherein a length of the part of the internal wall (75) in contact with an inside of the mouth (2) is equal to at least a sixth of an internal diameter of the mouth (2) for guaranteeing a good seal between the reducer and the container and for increasing the stability of the contact between the reducer and the container and reducing the possibility that reducer can be unseated from the container.

5. The capsule of claim 1, wherein it comprises:

a cylindrical cavity (76) coaxial of the reducer, on the bottom of which the hole (71) is afforded;

a wall of the cylindrical cavity (76) superiorly open;

a second annular cavity (77), coaxial of the first annular cavity (73) and internal thereto, delimited by the internal wall (75) and the wall of the cylindrical cavity (76).

6. The capsule of claim 1, wherein the first annular cavity (73) internally provides an annular recess (74*a*) which is afforded in the upper internal part of the external wall (74), the recess (74*a*) representing an undercut with respect to the front part of the cavity (73).

* * * * *